US007530608B2

(12) United States Patent
Chen

(10) Patent No.: US 7,530,608 B2
(45) Date of Patent: May 12, 2009

(54) LOCKING/RELEASING APPARATUS

(75) Inventor: Ku-Feng Chen, Taipei (TW)

(73) Assignee: Compal Electronics, Inc., Taipei (TW)

( * ) Notice: Subject to any disclaimer, the term of this patent is extended or adjusted under 35 U.S.C. 154(b) by 505 days.

(21) Appl. No.: 11/378,329

(22) Filed: Mar. 20, 2006

(65) Prior Publication Data

US 2007/0007866 A1 Jan. 11, 2007

(30) Foreign Application Priority Data

Jun. 24, 2005 (TW) ..... 94210673 U

(51) Int. Cl.
*E05C 19/10* (2006.01)

(52) U.S. Cl. ..... 292/121

(58) Field of Classification Search ..... 292/65, 292/222, 121, 224, 98, 99, 102, 106, 163, 292/170, 169, 240, 241, 219, 220, 197, 340, 292/DIG. 7, 95, 108, DIG. 61, DIG. 4; 312/222, 312/319.2

See application file for complete search history.

(56) References Cited

U.S. PATENT DOCUMENTS 5,388,901 A * 2/1995 Asano ..... 312/222

6,669,246 B2 * 12/2003 Cowper ..... 292/194

* cited by examiner

*Primary Examiner*—Patricia Engle
*Assistant Examiner*—Mark Williams
(74) *Attorney, Agent, or Firm*—Ming Chow Sinorica, LLC

(57) ABSTRACT

The present invention relates to a locking/releasing apparatus, which comprises: a positioning mechanism disposed at a bottom plate of a fastener, a locking element, a positioning spring, a releasing spring, and a protruding pillar disposed at the bottom of a movable member, such that if the movable member is pushed into the fastener, the protruding pillar will be pushed to press against a guiding rim to rotate the locking element and drive the positioning spring to store energy, and if the protruding pillar continues to be pushed and blocked by the locking element, the protruding pillar will enter into a slot channel from a guiding gap. Then, the positioning spring releases energy to rotate the locking element in an opposite direction, and thus the protruding pillar is moved to a guiding concave to be accommodated and fixed. If the movable member is pushed inwardly further, the protruding pillar will be separated from the guiding concave and released from its locked state, and the positioning spring will release energy again to rotate the locking element in an opposite direction, and the movable member can be pulled outward to make said protruding pillar press said sliding rim so as to let said releasing spring store energy, and said releasing spring will release energy to rotate said locking element to its initial position until said protruding pillar leave said sliding rim.

5 Claims, 10 Drawing Sheets

LOCKING/RELEASING APPARATUS

BACKGROUND OF THE INVENTION

1. Field of the Invention

The present invention relates to a locking/releasing apparatus, and more particularly to a locking/releasing apparatus that uses two springs to produce a force to act with each other so as to improve the stability of the movements.

2. Description of the Related Art

A locking/releasing apparatus is a common device used in our daily life, and it is generally used for two interactive components. More precisely speaking, a locking/releasing apparatus is a movable member with respect to a fastener, and if the fastener is closed, it needs a latch to prevent any unintentional separation, and if it is necessary to release the latch, a force is applied to the movable member. A common example is a sliding track of a drawer.

Referring to FIGS. 1 and 2 for a pull-out apparatus, the keyboard comprises a fastener A, a storing groove B formed between the upper and lower panel of the fastener, a pull-out moving member C for placing the keyboard, and a recession D for fixing and containing a standard keyboard (not shown in the figures). In FIG. 2, if the movable member C is pushed into the storing groove B of the fastener A, the movable member C is set in a non-operating condition, so that an unintentional outward movement will not occur. Therefore, it is necessary to install a locking/releasing apparatus between the fastener A and the movable member C.

A prior art of locking/releasing apparatus, regardless of being used for a sliding track of a drawer or an electric or electronic device, basically needs a single spring for achieving the basic locking/releasing function. However, a single spring used for the fixing and popping operations is not stable and also lacks of a buffering effect. If the single spring design is applied to a precision object, the object will be shaken, and the movable member C will be fallen out easily.

SUMMARY OF THE INVENTION

The primary objective of the present invention is to provide a locking/releasing apparatus which can be applied effectively to a device including but not limited to the aforementioned keyboard and other movable members having a fastener.

Another objective of the present invention is to provide a dual-spring locking/releasing apparatus, such that the interaction produced by the torques of the springs can improve the stability of the movable member.

A further objective of the present invention is to provide a locking/releasing apparatus that provides a pillar of the movable member, such that the pillar can be limited, locked into a fixed position and released.

DETAILED DESCRIPTION OF THE PREFERRED EMBODIMENTS

Figure 1:
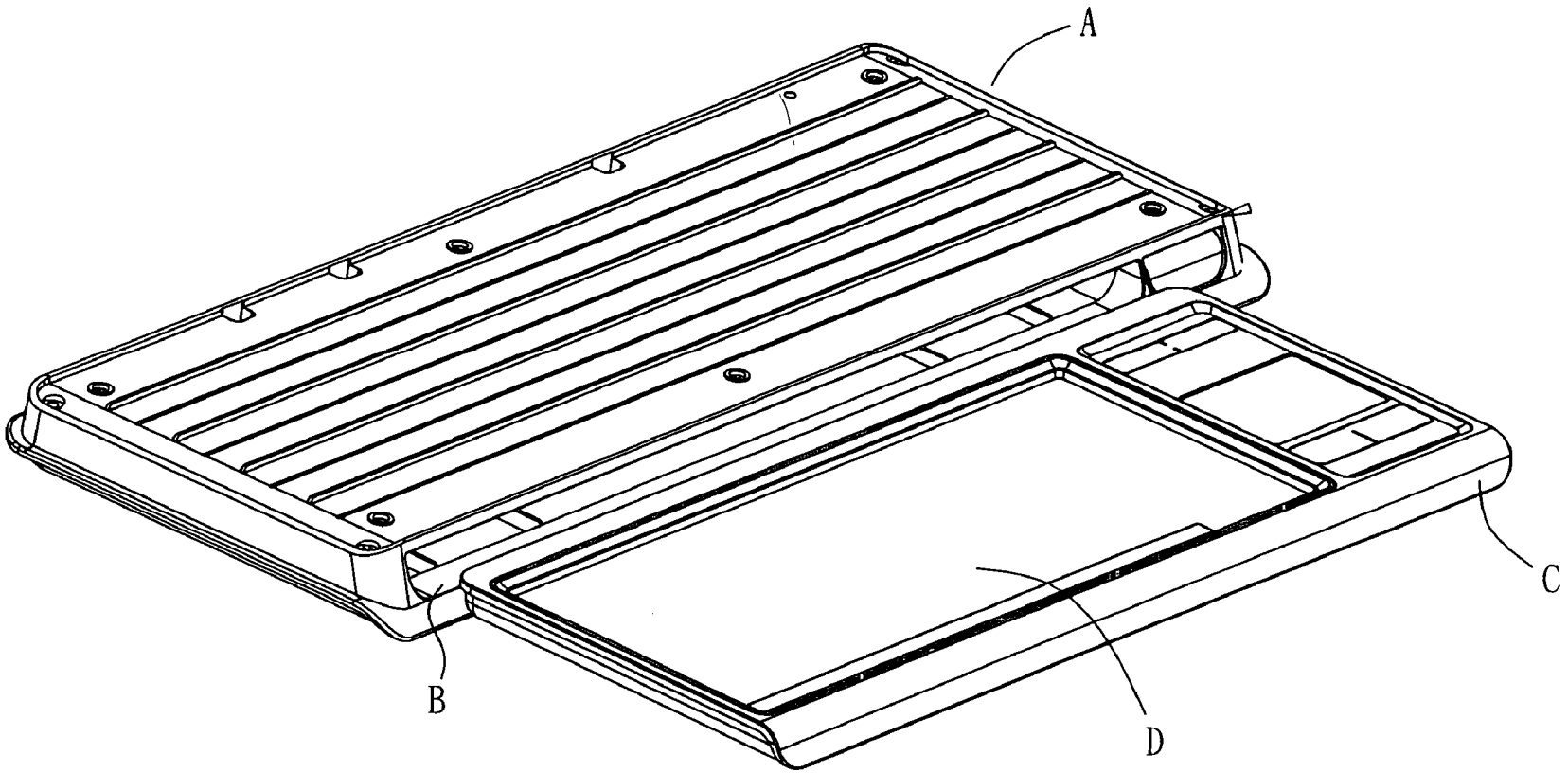
FIG. 1 is a schematic view of pulling out a movable member from a fastener.
Figure 2:
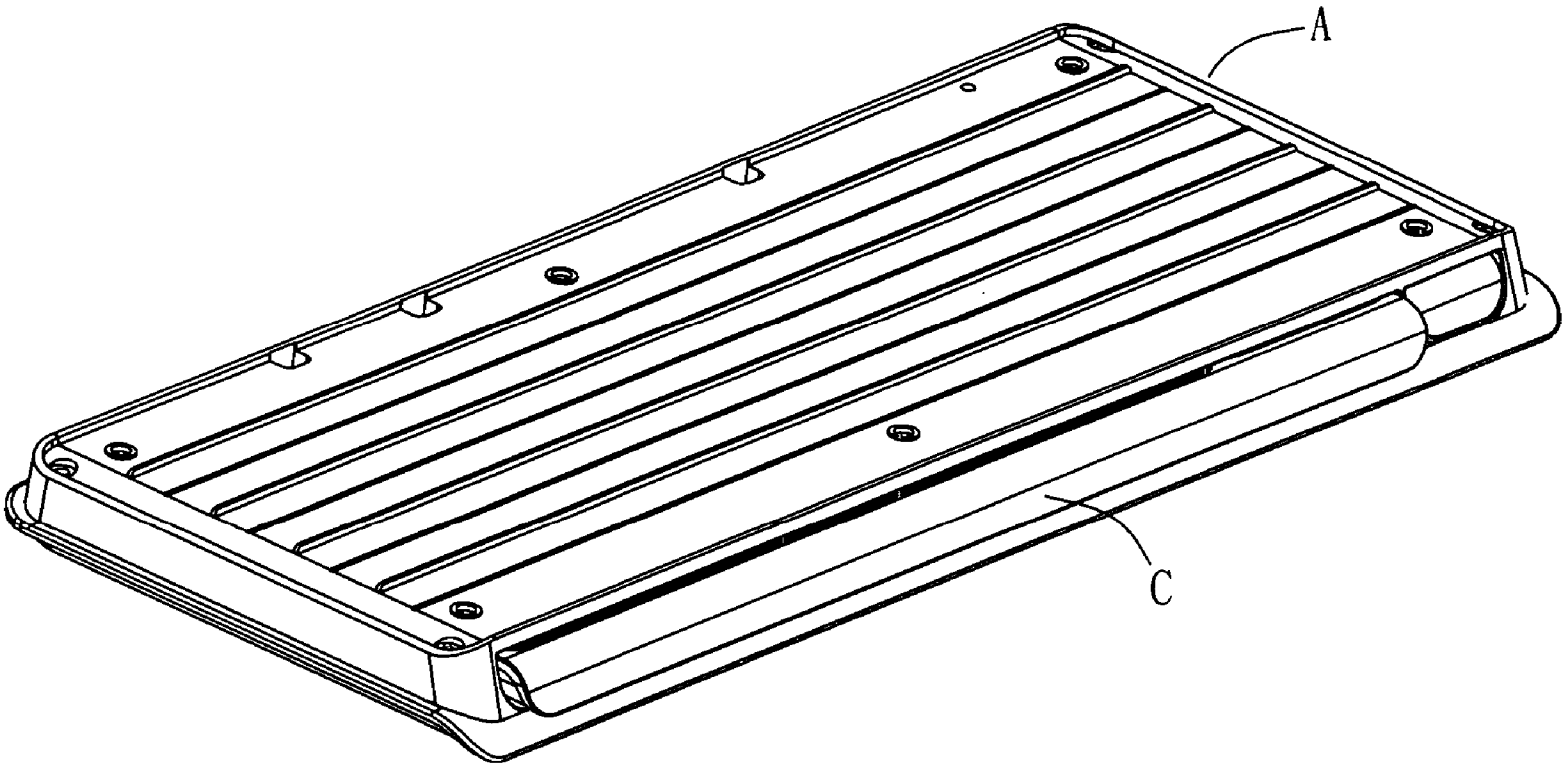
FIG. 2 is a schematic view of storing a movable member into a fastener.
Figure 3:
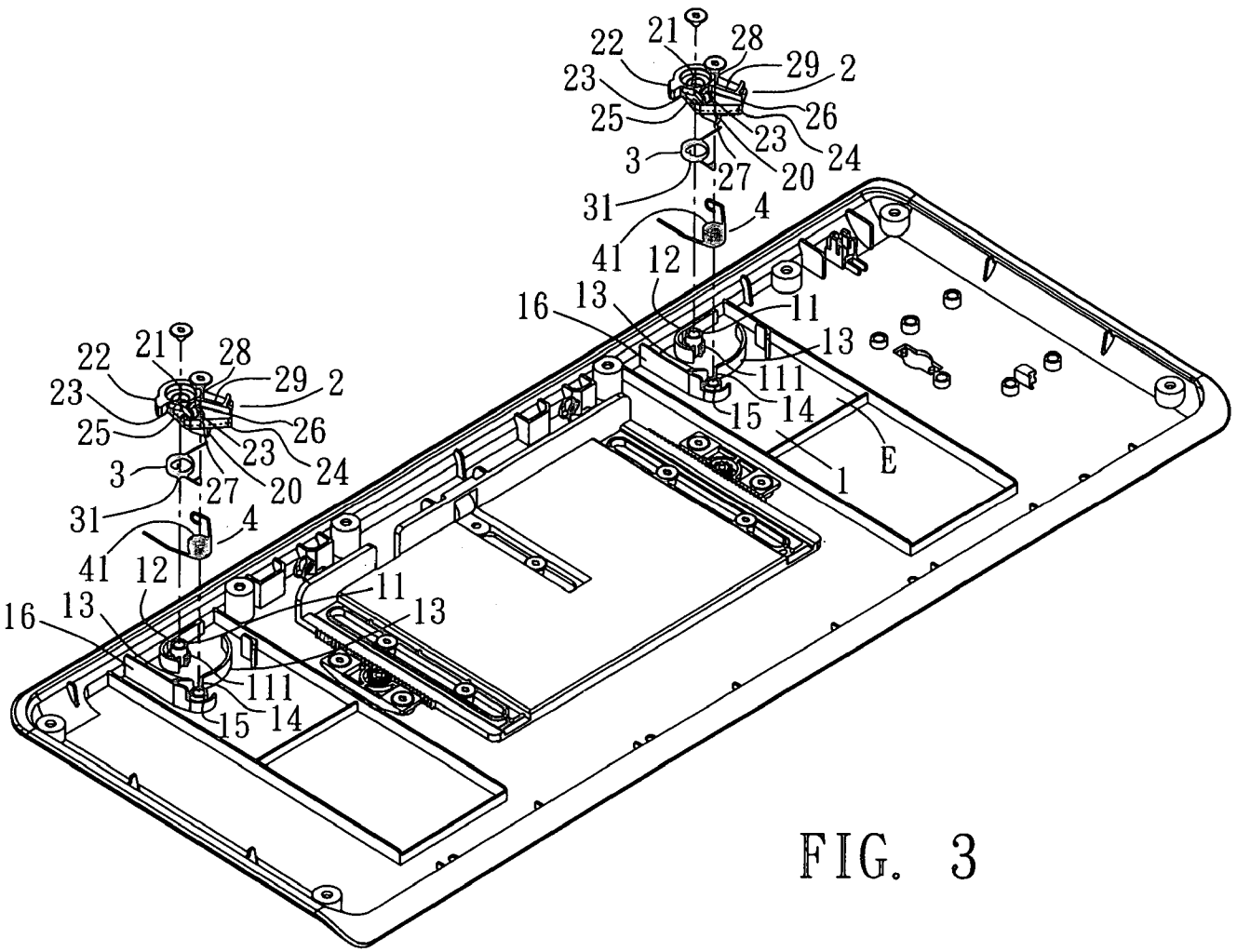
FIG. 3 is a schematic view of installing a fastener of the invention.
Figure 4:
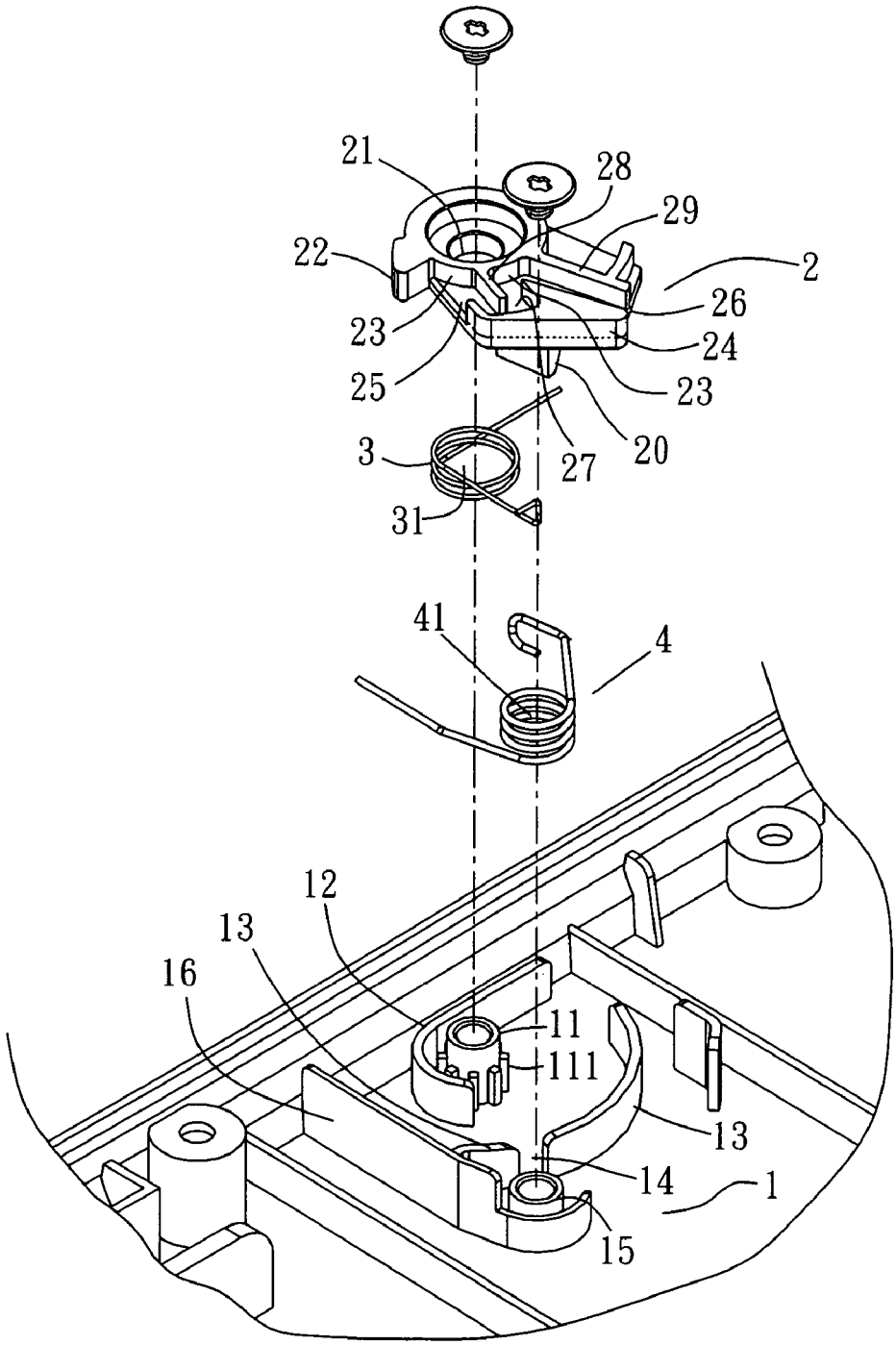
FIG. 4 is an exploded view of installing a locking/releasing apparatus to a fastener according to the invention.
Figure 5:
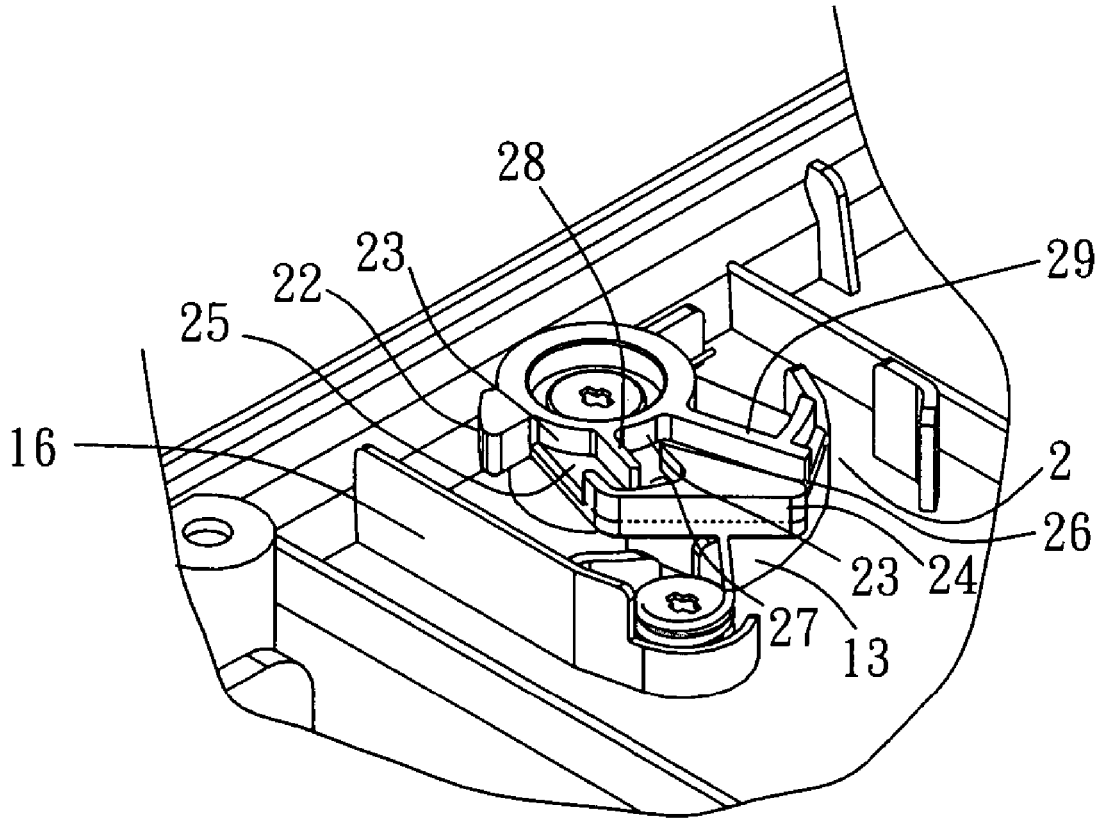
FIG. 5 is a perspective view of installing a locking/releasing apparatus to a fastener according to the invention.
Figure 6:
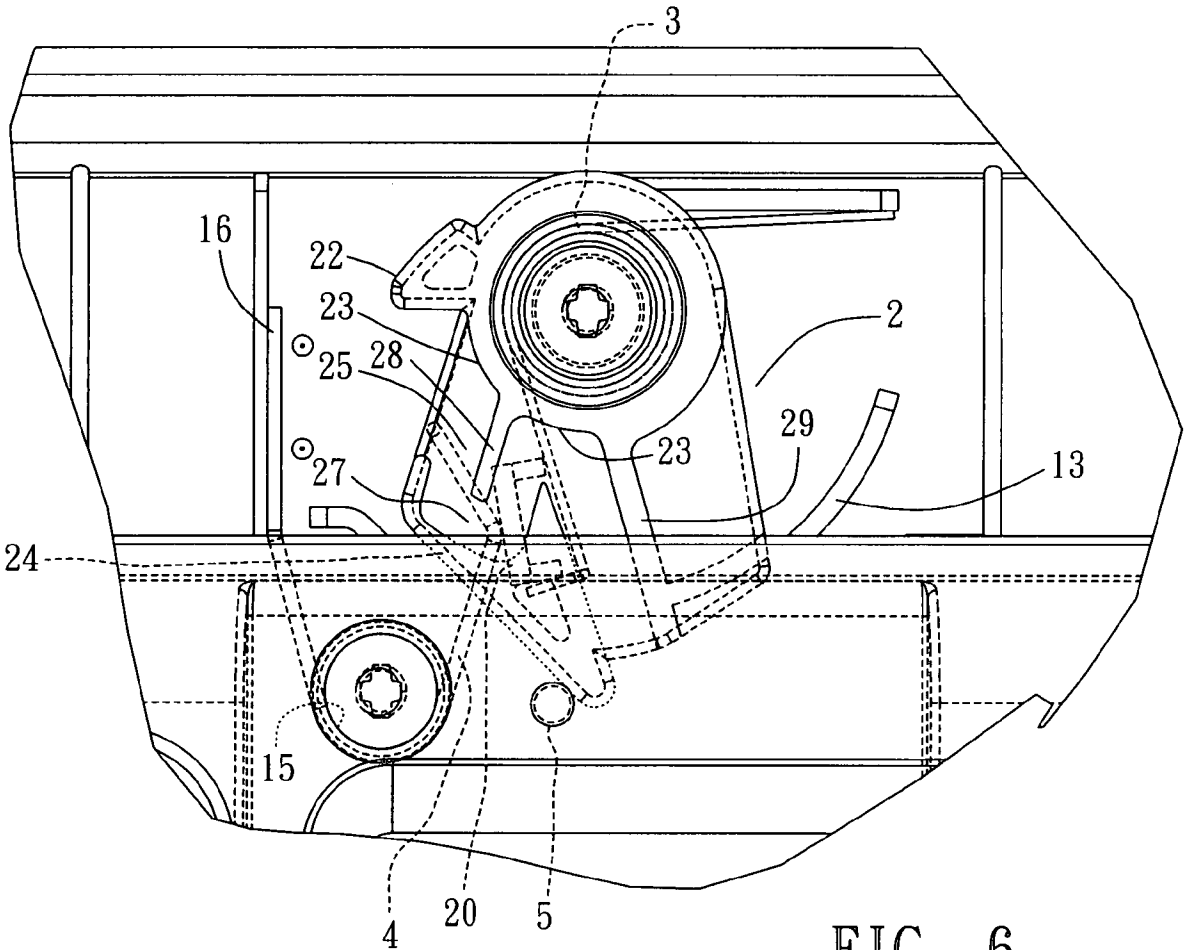
FIG. 6 is a schematic view of a locking/releasing apparatus when it is not operated according to the invention.
Figure 7:
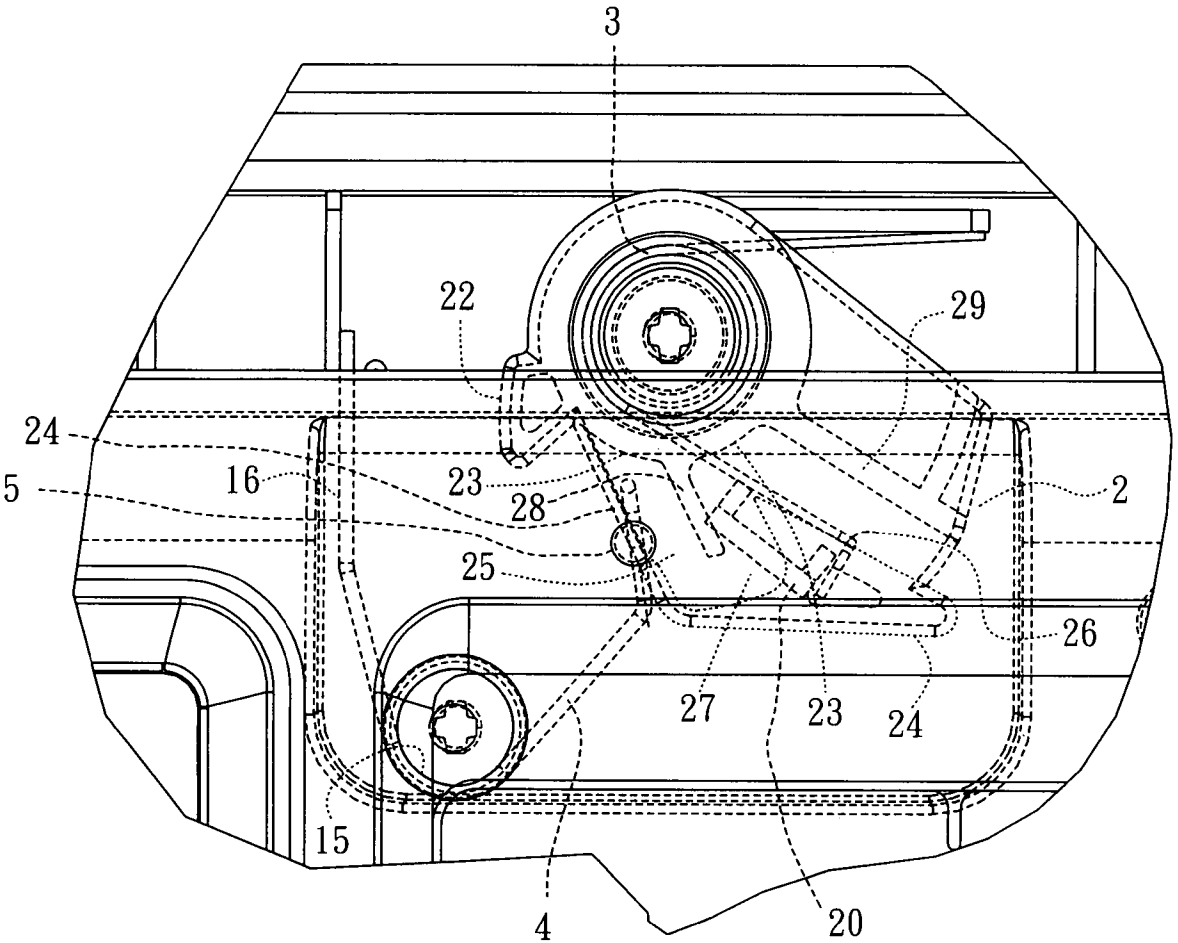
FIG. 7 is a schematic view of a protruding pillar of a movable member interfering a locking/releasing apparatus according to the invention.
Figure 8:
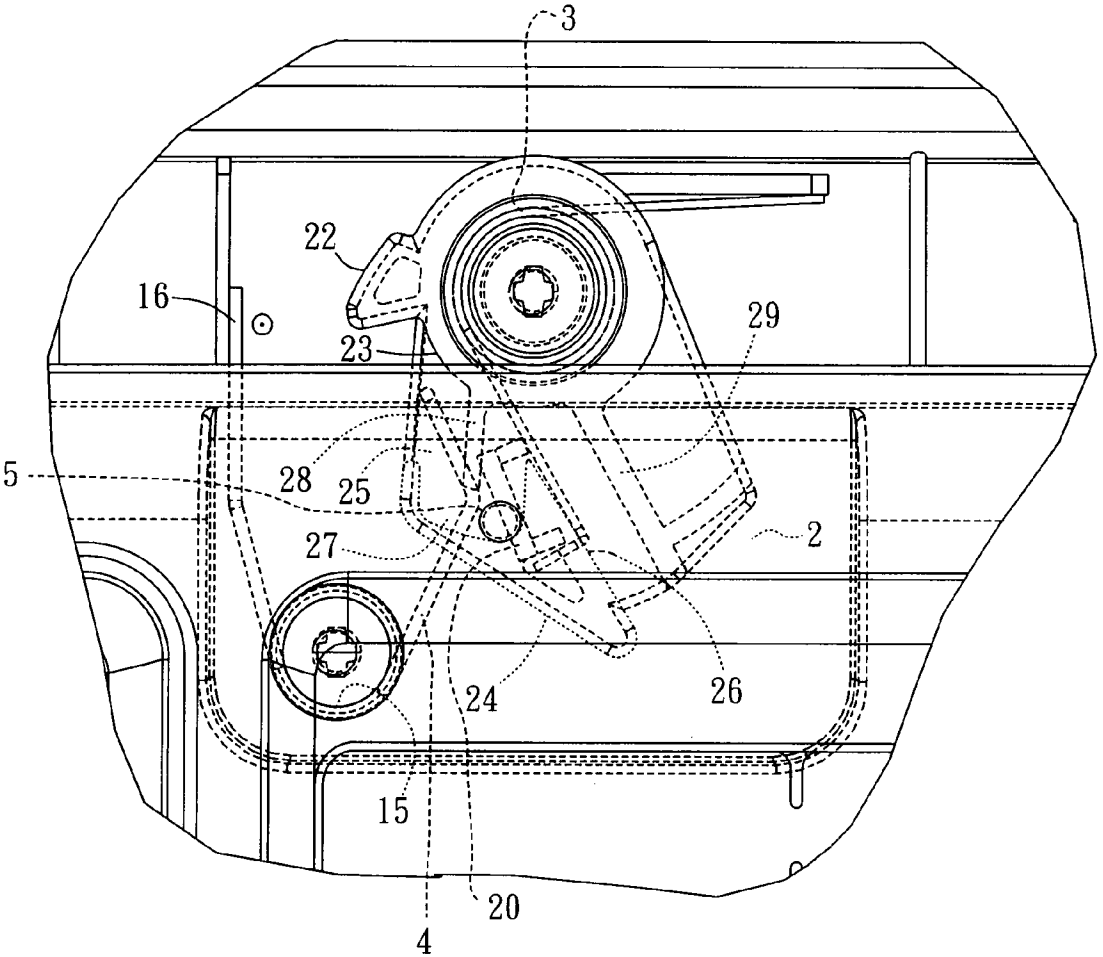
FIG. 8 is a schematic view of a protruding pillar of a movable member when it is locked according to the invention.
Figure 9:
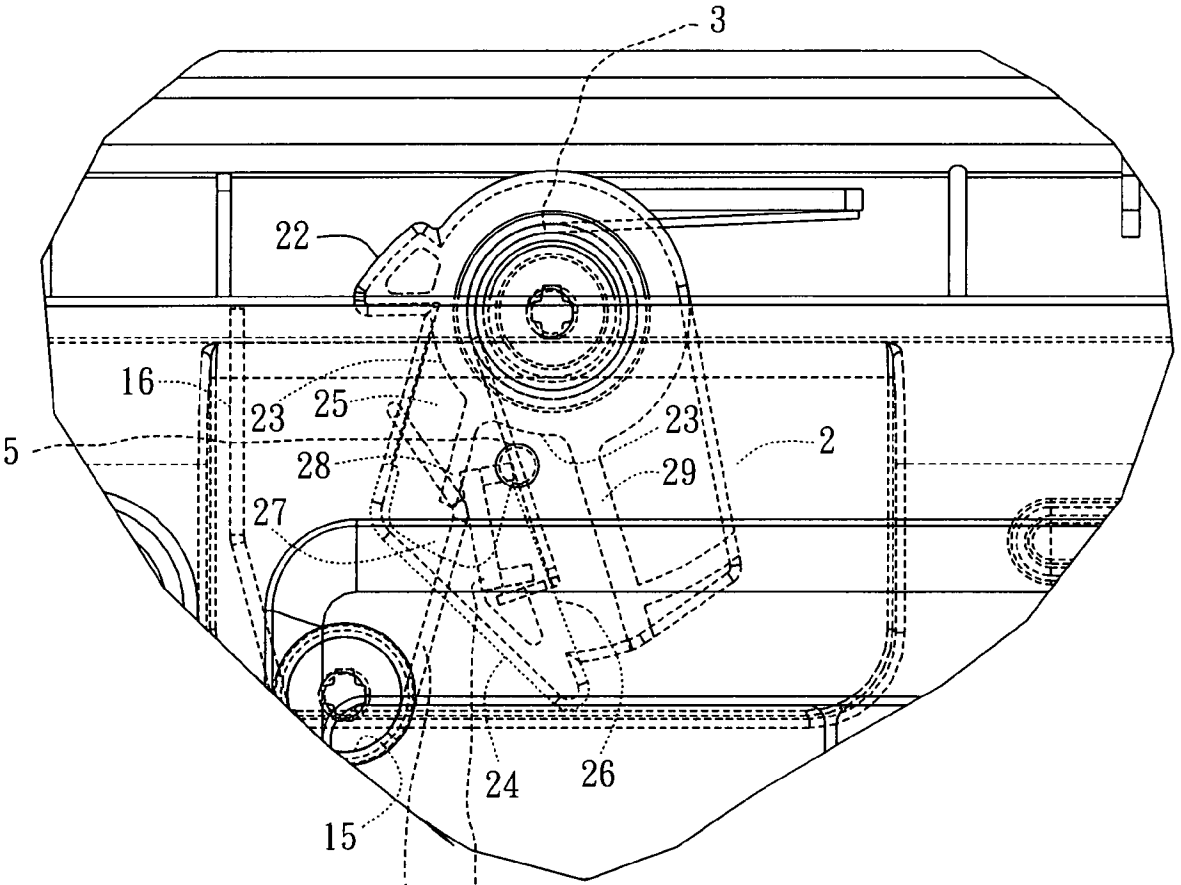
FIG. 9 is a schematic view of a protruding pillar of a movable member being separated from the locking groove.
Figure 10:
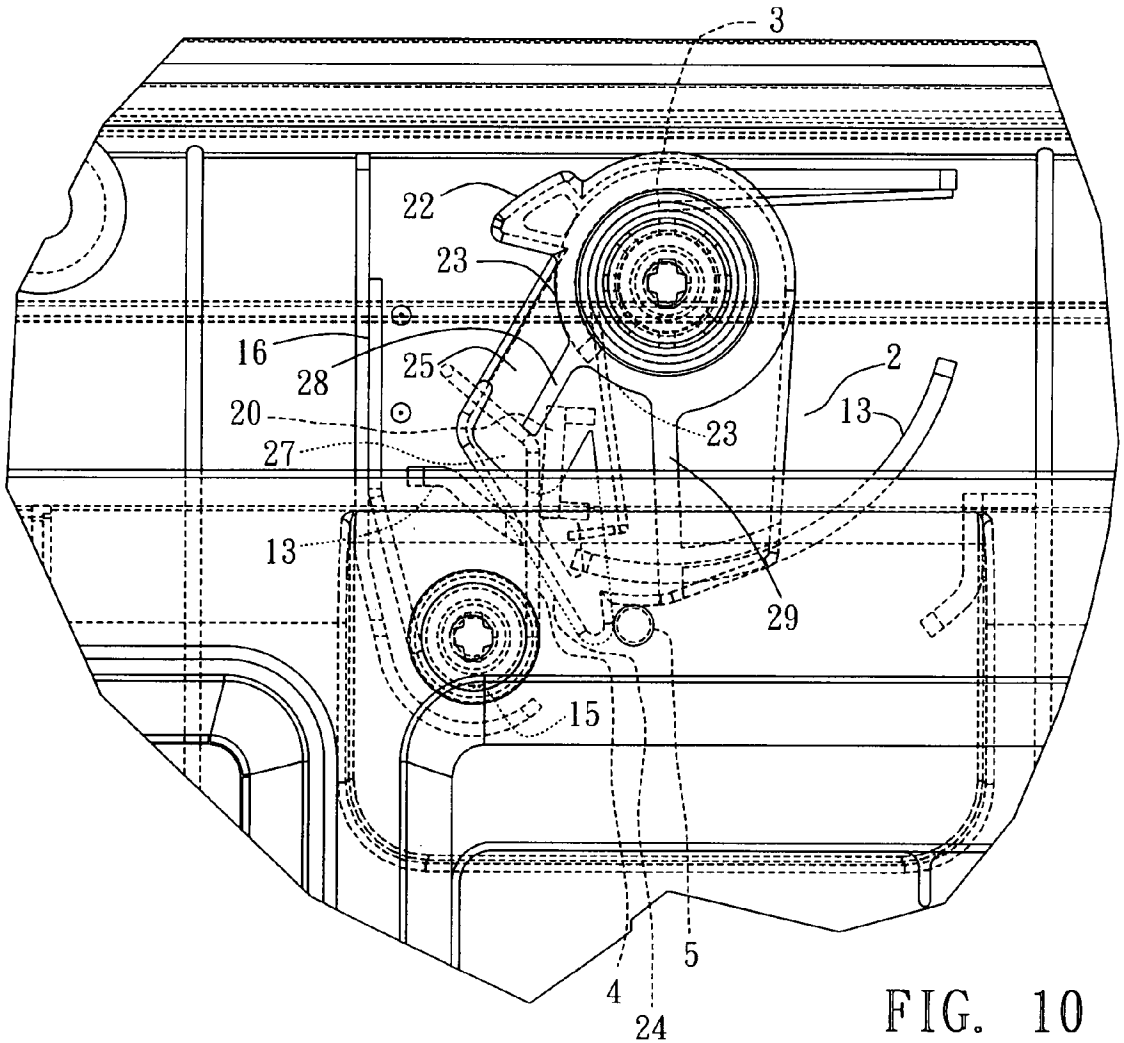
FIG. 10 is a schematic view of a protruding pillar of a movable member being released according to the invention.

Other features and advantages of the present invention will become apparent in the following detailed description of the preferred embodiments with reference to the accompanying drawings, in which FIG. 1 shows a schematic view of pulling out a movable member from a fastener; FIG. 2 shows a schematic view of storing a movable member into a fastener; FIG. 3 shows a schematic view of installing a locking/releasing apparatus to a fastener of the invention; FIG. 4 shows an exploded view of installing a locking/releasing apparatus to a fastener according to the invention; FIG. 5 shows a perspective view of installing a locking/releasing apparatus to a fastener according to the invention; FIG. 6 shows a schematic view of a locking/releasing apparatus when it is not operated according to the invention; FIG. 7 shows a schematic view of a protruding pillar of a movable member interfering a locking/releasing apparatus according to the invention; FIG. 8 shows a schematic view of a protruding pillar of a movable member when it is locked according to the invention; FIG. 9 shows a schematic view of a protruding pillar of a movable member being separated from the locking groove; and FIG. 10 shows a schematic view of a protruding pillar of a movable member being released according to the invention.

In FIG. 3, the locking/release apparatus of the invention is installed at a bottom plate E of a fastener A, and the bottom plate E forms a bottom of a groove body for storing a movable member. In FIG. 4, the locking/releasing apparatus comprises positioning mechanism 1, a locking element 2, a positioning spring 3, and a releasing spring 4 disposed on the fastener bottom plate E, and a protruding pillar 5 disposed at the bottom of the movable member.

The positioning mechanism 1 protruded from the bottom plate E of the fastener A includes a positioning rod 11 for engaging and positioning a positioning spring 3, a screw hole disposed at its center, a first pressing component 12 as shown in the figure being a positioning wall disposed at the external side of the positioning rod 11 and having an arc front section and a straighter rear section. To enhance the interference after the positioning spring 3 is engaged, the exterior of the positioning rod 11 includes a plurality of equidistant pillar stripes 111. Further, a positioning partition 13 is positioned at the side without the positioning wall 12 of positioning rod 11, and a gap of positioning indentation 14 is provided for passing through a releasing spring 4. Referring to FIG. 4, a positioning tenon 15 including a screw hole at the central is provided for engaging the releasing spring 4. Further, a blocking wall 16 an arc front section and a straight rear section is protruded from the position corresponding to the positioning tenon 15. The locking element 2 is an object with a fixed shape and having a positioning hole 21 at the central for engaging the aforementioned corresponding positioning rod 11, and being passed through a screw hole of the positioning rod 11 and then fixed by a screw. A blocker 22 is extended from the external periphery of the positioning hole 21 of the locking element 2 and coupled to a blocking ring 23 having a section of circular movement. A slanting guiding rim 24 is disposed at the front end of the locking element 2, and a guiding gap 25 is disposed between an end of the slanting guiding rim 24 and the blocker 22. In the meantime, a sliding rim 26 is formed on the other side of the guiding rim 24 and extended outward along a slanting direction, a guiding concave 27 is disposed between the guiding rim 24 and the sliding rim 26, the blocking rod 28 extended from the blocking ring 23 and the sliding rim 26 are slightly parallel to the blocking wall 29, such that a slot channel is formed among the blocker 22, guiding concave 27, blocking rod 28, sliding rim 26, and blocking wall 29. Furthermore, a blocking sheet 20 is extended downward from the bottom.

The positioning spring 3 has a positioning spring hole 31 at the middle for engaging a pillar stripe 111 of the positioning rod 11, such that one end of the positioning spring 3 presses against the positioning wall when the positioning spring 3 is installed.

The releasing spring 4 includes a releasing spring hole 41 at the middle for engaging with the positioning tenon 15, such that an end presses against the blocking wall 16 and the other end presses against the blocking sheet 20 when the releasing spring 4 is installed.

The protruding pillar 5 is protruded from the bottom of the movable member and having a size sufficient for moving on the slot channel.

Referring to FIG. 5 for the installation of the invention, the positioning spring 3 is engaged to the pillar stripes 111 under the positioning rod 11, and the releasing spring 4 is engaged with the positioning tenon 15, and then the locking element 2 is engaged with the positioning rod 11 through the positioning hole 21 and fixed into the screw hole by a screw. Another screw is screwed to fix the positioning tenon 15 into the screw hole.

Referring to FIG. 6 for the movable member being withdrawn and stored, the protruding pillar 5 moves forward along the guiding rim 24. Since the protruding pillar 5 of the movable member moves forward in a linear manner, therefore the locking element 2 is rotated counterclockwise to exert a force onto the positioning spring 3 for storing energy. In FIG. 7, when the protruding pillar 5 is situated at the end of the guiding rim 24 and reaches the guiding gap 25, the turning angle of the locking element 2 becomes larger. In FIG. 8, the locking element 2 is rotated clockwise, when the positioning spring 3 releases its energy, and the protruding pillar 5 enters into the slot channel and is disposed in the guiding concave 27 to complete the locking process. During this process, the releasing spring 4 will not interfere the blocking sheet 20. Referring to FIG. 9, if it is necessary to remove the movable member, the movable member is pushed inward, so that the protruding pillar 5 moves upward along the guiding concave 27 at a lateral side of the blocking rod 28, and the locking element 2 rotates clockwise. Now, the protruding pillar 5 is moved away from the guiding concave 27 and situated at an end of the sliding rim 26.

Referring to FIG. 10, when the movable member is pulled outward, the protruding pillar 5 is separated from the slot channel at the sliding rim 26, and the releasing spring 4 will be pressed by the blocking sheet 20 and set into the status of storing energy. After the protruding pillar 5 is separated from the slot channel completely, the protruding pillar 5 can be removed so as to be set in a non-locking status, and the releasing spring 4 releasing energy to rotate the locking element 2, such that the locking element 2 resumes its original position.

With the present invention, the locking and positioning purposes can be achieved definitely, and the rest of the locking and position is acted by the interactions of the two springs, so that the invention can have a high stability, which can prevent vibrations or collisions caused by the prior art single spring.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

In summation of the above description, the present invention herein enhances the performance than the conventional structure and further complies with the patent application requirements and is submitted to the Patent and Trademark Office for review and granting of the commensurate patent rights.

What is claimed is:

1. A locking/releasing apparatus, comprising:

a positioning mechanism, protruded from a bottom plate of a fastener and having a positioning rod and a first stopping element being disposed at external periphery of the positioning rod; a positioning tenon protruded from a side of the positioning mechanism and having a second stopping element positioned at external periphery of the positioning tenon;

a locking element, pivotally coupled to said positioning rod and having a guiding gap disposed between a slanting guiding rim and a blocker, and an aslant expanded sliding rim being disposed on another side of said guiding rim, and an inwardly concave guiding gap being disposed between an end of said sliding rim and an end of said guiding rim, and a concave bent slot channel being formed, and a blocking sheet being extended downward from the bottom of said locking element;

a positioning spring having two ends and a positioning spring hole wherein a pillar stripe is being engaged, the positioning spring also being engaged with said positioning rod and having one of the two ends pressing against said first stopping element and the other end pressing against said blocking sheet;

a releasing spring having a releasing spring hole wherein the positioning tenon is being engaged, the releasing spring also being engaged with said positioning tenon and having both ends pressing against said second stopping element and said blocking sheet; and a protruding pillar, disposed at bottom of a movable member, wherein when said movable member is pushed into said fastener, said protruding pillar presses said guiding rim to rotate said locking element and drive said positioning spring to store energy, and said protruding pillar enters into said slot channel from said guiding gap, and said positioning spring releases energy to rotate said locking element in an opposite direction and move said protruding pillar to said guiding concave to be blocked; and when said movable member is pushed inward further, said protruding pillar is separated from said guiding concave and positioned at an end of said sliding rim, and said positioning spring releases energy to rotate said locking element in an opposite direction, and said movable member is pulled outward to make said protruding pillar press said sliding rim to let said releasing spring store energy, and said releasing spring releases energy to rotate said locking element to initial position of the locking element until said protruding pillar leaves said sliding rim.

2. The locking/releasing apparatus of claim 1, wherein said positioning rod having a screw hole, and being engaged with a screw for positioning said locking element and said positioning spring.

3. The locking/releasing apparatus of claim 1, wherein said positioning rod having a screw hole, and being engaged with a screw for positioning said releasing spring.

4. The locking/releasing apparatus of claim 1, wherein said first stopping element is a positioning wall.

5. The locking/releasing apparatus of claim 1, wherein said second stopping element is a blocking wall.

* * * * *